United States Patent [19]

Graham et al.

[11] 3,955,938

[45] May 11, 1976

[54] GASOLINE COMPOSITION CONTAINING A SODIUM ADDITIVE

[75] Inventors: John P. Graham, San Antonio, Tex.; Jack Ryer, East Brunswick, N.J.; Sidney J. Lestz, San Antonio, Tex.

[73] Assignee: Exxon Research and Engineering Company, Linden, N.J.

[22] Filed: Aug. 21, 1973

[21] Appl. No.: 390,308

[52] U.S. Cl. ..... 44/51; 44/67; 44/68

[51] Int. Cl.[2] ..... C10L 1/32

[58] Field of Search ..... 44/51, 67, 68

[56] References Cited

UNITED STATES PATENTS

| | | | |
|---|---|---|---|
| 2,546,421 | 3/1951 | Bartholomew et al. | 44/67 X |
| 2,764,548 | 9/1956 | King et al. | 44/68 X |
| 3,182,019 | 5/1965 | Wilks et al. | 252/18 |
| 3,506,416 | 4/1970 | Patkin et al. | 44/68 X |

FOREIGN PATENTS OR APPLICATIONS

| | | | |
|---|---|---|---|
| 944,738 | 12/1963 | United Kingdom | 44/51 |

*Primary Examiner*—Allen B. Curtis
*Assistant Examiner*—Y. Harris-Smith
*Attorney, Agent, or Firm*—Frank T. Johmann

[57] ABSTRACT

Sodium containing additives in gasoline reduce valve seat recession and give other improvements in automotive internal combustion engines operating on lead-free gasoline. Preferably, the sodium-containing additive is a sodium derivative of an organic compound, e.g., a salt of an organic acid, or a dispersion of a sodium salt of an inorganic acid, e.g., a sodium carbonate dispersion.

1 Claim, No Drawings

GASOLINE COMPOSITION CONTAINING A SODIUM ADDITIVE

BACKGROUND OF THE INVENTION

With the removal of lead additives, e.g., tetraethyl lead and tetramethyl lead, from gasoline in order to reduce air pollution, it has been found that the lead had acted not only as an antiknock agent, but was also effective in contributing towards the prevention of valve seat recession. In the conventional internal combustion gasoline engine, the inlet and exhaust valves generally seat against their valve seats with a slight rotary motion. This rotary motion is imparted to the valve stem during its operation to constantly shift the relative position of the valve to prevent uneven wear on the valve tip. This rotary motion also prevents the valve from seating exactly the same every operation. With the elimination of the lead additives from gasoline, it has been found that a drastic increase in wear of the valve seat occurs. In fact, actual recession of the valve seat occurs, probably partly due, or aggravated, by rubbing of the valve against its seat as the aforesaid rotary motion occurs. The result is an eventual loss of compression and power.

Recession or exhaust-valve seat wear apparently results from a wearing of the valve seat by the exhaust valve. The seat material is slowly worn away, while the harder valve escapes relatively undamaged. It is believed that lead prevents this problem by forming protective oxide layers.

Valve seat wear is a function of engine design, load and speed conditions, and valve operating temperature. Valve seat wear is most severe under high speed, high load conditions with rotating valves. Recession may still occur in engines not equipped with valve rotators and operating under stop-and-go conditions.

In the past, sodium additives have been suggested for lubricating oils. For example, U.S. Pat. No. 3,182,019 discloses the use of sodium containing materials as oil additives, and U.S. Pat. No. 2,616,904 discloses the use of alkaline earth metal containing materials as oil additives. The addition of sodium additives to lubricating oils, however, is usually made only in premium high cost motor oils, and, thus, engine users selecting a lower grade oil will not derive the benefits to be obtained from the use of sodium additives in lubricating oils. Further, although the use of sodium additives in lubricating oils reduces valve seat wear, it does not eliminate all recession that may occur under severe driving conditions.

SUMMARY OF THE INVENTION

The present invention is based upon the discovery that sodium containing additives can be incorporated in gasoline and are effective in inhibiting the occurrence of the aforesaid valve seat recession when the engine operates on lead-free gasoline. The sodium additive may be added in a number of different forms, such as sodium derivatives of organic compounds which are soluble, or dispersed, in the gasoline, e.g., simple sodium salts of an organic acid, such as sodium petroleum sulfonate. However, the sodium is preferably added in the form of a sodium salt of an inorganic acid, e.g., sodium carbonate, in a colloidal dispersion in oil, which dispersion is stabilized by surfactants, since this represents a particularly economical manner of introducing the sodium. U.S. Pat. No. 3,182,019 and British Pat. Nos. 921,124; 940,175; and 943,777 teach such colloidal dispersions of sodium carbonate and methods for their formation. Preferably, the dispersions are overbased and the surfactant is a gasoline soluble metal salt of a $P_2S_5$ treated $C_2$ to $C_6$ olefin polymer having a molecular weight of about 700 to 100,000.

In brief, the present invention is directed to gasoline compositions, particularly lead-free gasoline compositions, containing a sodium additive. While gasolines containing the sodium additive have a distinct advantage when the gasoline is unleaded, they are also suitable for use with leaded gasoline. In addition, tests of the gasolines of the present invention show improvements over conventional gasolines by decreasing valve burning, lowering hydrocarbon emissions from the exhaust, producing good combustion chamber and valve cleanliness, reducing varnish on pistons and decreasing sludge and varnish in crankcase parts and valve covers. Also, good results are achieved in obtaining lower surface ignition and octane requirement increase, etc., as compared to other metals.

DETAILED DESCRIPTION OF THE INVENTION

The gasoline compositions of the invention include a major amount of gasoline containing sufficient sodium additive to incorporate about 0.5 to 20, preferably 0.5 to 10, and most preferably 0.5 to 4.0 pounds of sodium per thousand barrels of gasoline, one barrel containing 42 U.S. gallons. A concentration of 1 pound per thousand barrels of gasoline is roughly equivalent to about 3.4 parts per million; thus the most preferred range of 0.5 to 4 pounds per thousand barrels (ptb) is about $1.7 \times 10^{-4}$ to about $13.6 \times 10^{-4}$ percent by weight.

If a sodium derivative of an organic material is incorporated into the gasoline, the exact form of the organic portion of the molecule does not appear critical, provided that it is dissolved or dispersed so as to give a clear gasoline containing the desired amount of sodium. Thus, under combustion conditions where temperatures may be on the order of 5000°F., the organic portion of the molecule is combusted and it is the sodium containing ash that remains in the combustion chamber that appears to be effective in preventing valve seat recession.

A convenient form of sodium derivatives is sodium salts of sulfonic acids, which acids generally will have molecular weights of about 300 to about 700, and can be either synthetic, or prepared by sulfonating petroleum fractions. Examples of these sulfonic acids include alkylated benzenes or naphthalenes, having 1 to 4 alkyl groups of 8 to 20 carbons each, such as: dinonylbenzenesulfonic acid, trinonylbenzenesulfonic acid, didodecylbenzenesulfonic acid, di-cetylnaphthalenesulfonic acid, diisononylbenzylsulfonic acid, wax substituted benzenesulfonic acids, etc. Petroleum sulfonic acids may also be used, such as mahogany sulfonic acid, white oil sulfonic acid, petrolatum sulfonic acid, etc.

Another class of materials that can be used in the practice of the present invention is sodium salts of saturated and unsaturated carboxylic acids, such as fatty acids containing from about 1 to about 30 carbon atoms, such as formic acid, acetic acid, lauric acid, palmitic, oleic, linolenic, myristic, etc. Other sodium materials that can be used are the salts of phosphosulfurized hydrocarbons usually prepared by reacting $P_2S_5$ with petroleum fractions such as bright stock, or as is more often the case, with polyolefins of 2 to 6 carbon atoms, and particularly polybutenes having molecular weights of 700 to 100,000.

Other sodium salts can be formed by reaction with phenol; alkyl phenols, e.g., where phenol has 1 to 4 alkyl groups of 1 to 20 carbons each; phenol sulfides where phenol or alkyl phenol is reacted with sulfur, etc. Alkyl phenols of 200 to 700 molecular weight made by alkylating phenol with diisobutylene or tripropylene are well known in the additive art and are included.

To obtain the sodium in as high a concentration as possible, at the least cost, low molecular weight sodium compounds are particularly desirable. These compounds may have low molecular weights, e.g., under 200, preferably under 150. Examples include sodium materials, such as sodium hydroxide, and sodium salts of: fatty acids, e.g., formic, acetic, etc.; inorganic acids, e.g., $CO_2$, $CS_2$, $H_3BO_3$, HCl, $H_3PO_4$, etc. These low molecular weight sodium compounds will invariably be gasoline insoluble, but can be used in the form of dispersions stabilized by surfactants. Suitable surfactants include the oil-soluble salts of the higher molecular weight organic acids previously mentioned, e.g., $C_{18-30}$ fatty acids, the sulfonic acids, the phosphosulfurized hydrocarbons, etc. General methods for preparing colloidal dispersions of insoluble salt types are well known in the art and have been described in numerous patents such as those previously specifically mentioned, as well as others, e.g., British Pat. Nos. 743,842; 744,405; 744,683, etc.

Generally speaking, the dispersions can be prepared by adding the acidic component, e.g., carbon dioxide, and base, e.g., sodium hydroxide, to a solvent or solution comprising the surfactant, water, and generally a so-called "promoter" followed by dehydration. Direct reaction of the base and acidic component will frequently give undispersed product. Therefore, the base, e.g., NaOH, is reacted with the promoter, e.g., phenol, alcohol, glycol, etc. in the presence of at least some water (e.g., the base may be added as an aqueous solution) to form a salt of the promoter. The mixture is dehydrated, and acidic material is added, e.g., $CO_2$, to liberate the metal from the promoter and form the salt which is now colloidally dispersed in the oil by the surfactant. If volatile, the promoter may be evaporated, or it may be left in the dispersion. In other cases, a salt of the promoter is preformed, e.g., sodium alkoxide, and this is added to the oil-surfactant mixture followed by the addition of the metal base and heating. Although most of the prior art is directed to alkaline earth metal salts, numerous surfactants, promoters, and techniques of preparing these materials are known, e.g., see U.S. Pat. Nos. 3,451,931; 2,616,904; 3,471,403; 3,492,231; etc., as well as the various patents cited therein. These colloidal dispersions have been referred to in the past as "complexes," or "overbased," "superbased," or "hyperbased" additives.

The gasolines in which the additives of this invention are employed are conventional petroleum distillate fuels boiling in the gasoline range and intended for internal combustion engines, preferably spark ignition engines. Gasoline is defined as a mixture of liquid hydrocarbons having an initial boiling point somewhere in the range of about 70° to 135°F., and a final boiling point somewhere in the range of about 250° to 450°F. Gasolines are supplied in a number of different grades, depending upon the type of service for which they are intended. The additives of the invention are particularly useful in motor and aviation gasolines. Motor gasolines include those defined by ASTM specification D-439-58T, Types A, B and C and are composed of a mixture of various types of hydrocarbons, including aromatics, olefins, paraffins, isoparaffins, naphthenes and occasionally diolefins. Not all of these types of hydrocarbons will necessarily be present in any particular gasoline. These fuels are derived from petroleum crude oil by various refining processes, including fractional distillation, catalytic cracking, hydroforming, alkylation, isomerization, polymerization and solvent extraction. Motor gasolines normally have boiling ranges within the limits of about 70°F. and about 450°F., while aviation gasolines have narrower boiling ranges, within the limits of about 100°F. and 330°F. The vapor pressures of gasoline as determined by ASTM Method D-323 vary between about 5 and about 18 psi at 100°F. The properties of aviation gasolines are set forth in U.S. Military Specification MIL-F-5572 and ASTM Specification D-910-57T.

Other additives conventionally employed in gasolines can be present in the final gasoline formulation in practicing the present invention. These additives include corrosion inhibitors, rust inhibitors, antiknock compounds, antioxidants, solvent oils, antistatic agents, octane appreciators, e.g., t-butyl acetate, dyes, anti-icing agents, e.g., isopropanol, hexylene glycol, ashless dispersants, detergents, and the like, as is well known in the gasoline art.

The invention will be further understood by reference to the following examples, which include a preferred embodiment of the invention.

EXAMPLE 1

A gasoline dispersable sodium additive is prepared as follows: A mixture of 43.35 lbs. of a $P_2S_5$ treated polyisobutylene (surfactant) having a molecular weight of about 900, and 23.65 lbs. of alkyl phenol (promoter) having a molecular weight of about 240 and wherein the alkyl groups are $C_8$ and $C_{12}$ groups derived from isobutylene, dissolved in 133 lbs. of a paraffinic hydrocarbon mineral oil, is prepared and heated to 295° ± 10°F. An aqueous solution containing 50 wt. % sodium hydroxide and carbon dioxide is added simultaneously over a period of about 2.5 hours while maintaining a temperature in the range of 295° ± 10°F. using 102.7 lbs. of sodium hydroxide and 55 lbs. of $CO_2$. Next, the temperature is raised to 300°F. and held for 0.5 hour, following which the product is filtered.

The resulting additive is characterized as a concentrate of sodium carbonate dispersed in a lubricating oil with a sodium salt of a $P_2S_5$ treated polyisobutylene as surfactant and containing about 17 wt. % sodium, 0.45 wt. % phosphorus and having a total base number (T.B.N.) of 400.

Another typical preparation of this additive is represented by Additive L of British Pat. No. 921,124.

EXAMPLE 2

A number of engine tests are conducted on a new 1970 Chrysler automobile having a 440 cubic inch displacement engine. A commercial premium grade unleaded Amoco premium gasoline is initially used to fuel the automobile in a high speed (70 mph) driving test. The gasoline has the following typical inspections: API gravity of 51.8 at 60°F., 53.3% aromatics, 2.3% olefins, 44.4% saturates, 89.52% C, 10.47% H, a lead content of 0.2 gm. of lead per gallon, e.g., less than 2 ppm., sulfur of 0.001%, a research octane (clear) number of 101 and a motor octane (clear) number of 90 to 91. The car is lubricated with a crankcase motor oil containing an ashless dispersant which is a condensation product of polyisobutenyl succinic anhydride and tetraethylene pentamine; an overbased calcium alkyl aryl sulfonate as a rust inhibitor, a zinc dialkyl dithiophosphate for antiwear; and a hydrocarbon polymer V.I. improver.

The car is driven at 70 mph for 6,000 miles and then the valve recession of the engine is measured. The valves and seats are replaced and the car is run an additional 6,000 miles on the same crankcase lubricant and fuel, except that the fuel now contains 20 ptb of the additive of Example 1. Recession measurements are made every 1,000 miles during the later run to obtain both wear rates and final wear levels.

A second 1970 Chrysler automobile is tested under identical conditions but with a fuel containing 0.3 TP (theories of phosphorus) cresyldiphenyl phosphate. Similarly, two 1970 Fords are tested under identical conditions but one is operated with a fuel containing 20 ptb of the additive of Example 1 and the second with a fuel containing 0.3 TP of cresyldiphenyl phosphate.

The results of each test are summarized in the following table:

TABLE I

| | Valve Recession Inches × .001 | | | | | |
|---|---|---|---|---|---|---|
| | 1,000 Miles | 2,000 Miles | 3,000 Miles | 4,000 Miles | 5,000 Miles | 6,000 Miles |
| Chrysler Car No. 1 with unleaded fuel: | | | | | | |
| Intake | | | | | | — |
| Exhaust | | | | | | 66 |
| Maximum exhaust | | | | | | 121 |
| Chrylser Car No. 1 with unleaded fuel containing sodium additive: | | | | | | |
| Intake | 2 | 2 | 4* | 4* | 4* | 4* |
| Exhaust | 7 | 11 | 13* | 13* | 16* | 19* |
| Maximum exhaust | 14 | 17 | 24 | 19 | 26 | 27 |
| Chrysler Car No. 2 with leaded fuel: | | | | | | |
| Intake | 1 | 1 | 0* | 1** | 2* | 1 |
| Exhaust | 1 | 3 | 5 | 8 | 12* | 11 |
| Maximum exhaust | 5 | 13 | 15 | 21 | 23 | 23 |
| Ford Car No. 1 with unleaded fuel containing sodium additive: | | | | | | |
| Intake | 1 | 2 | 1 | 2 | 0 | 1 |
| Exhaust | 0 | 1 | 1 | 0 | 0 | 1 |
| Maximum exhaust | 2 | 3 | 4 | 2 | 4 | 6 |
| Ford Car No. 2 with leaded fuel: | | | | | | |
| Intake | 1 | 0 | 0 | 0 | 2 | 1 |
| Exhaust | 0 | 0 | 2 | 1 | 4 | 2 |
| Maximum exhaust | 3 | 4 | 9 | 10 | 13 | 12 |

*Average left head only
**Average 7 cylinders only

As seen by Table I, Chrysler Car No. 1 shows a drastic increase in the amount of recession of both the intake and exhaust valve seats when running with clear, unleaded gasoline as compared to Chrysler Car No. 2 where the same gasoline but with lead is used. When Chrysler Car No. 1 is run with unleaded gasoline containing a sodium additive in accordance with the present invention, significantly less valve seat wear occurs. Prior tests on similar 1970 Ford motor cars run on an unleaded fuel and lubricated with a fully formulated oil show an intake valve recession of 0.024 inches and an exhaust valve recession of 0.064 inches which valve recessions are significantly higher than those achieved by use of an unleaded fuel containing the sodium additive of the present invention as shown in Table I.

EXAMPLE 3

In this example, cycle temperature sludge tests are conducted on two gasolines. One of the engines is operated with a base gasoline containing the sodium additive of the present invention, and the other engine is operated with the identical base gasoline that does not contain the additive of the present invention. The cycle temperature sludge test tests the gasolines for sludge dispersing ability and, from prior experience, has been shown to give sludge deposits similar to those obtained in stop-and-go driving such as would be experienced in taxicab operation. Briefly described, in this test a Ford 6-cylinder engine is run on a dynamometer stand through alternate cycles, the first cycle lasting 5 hours, at 1,500 rpm, and the second cycle lasting 2 hours, at the same operating speed, with the oil pump and water jacket temperatures being slightly higher in the second cycle than in the first. The two cycles are alternated in sequence until the desired total test time has elapsed. Make-up oil is added as required so as to maintain the oil level in the crankcase at all times between about 3½ and 4 quarts. At the end of selected periods of test time, the engine is inspected by disassembling it sufficiently to permit visual examination of several of the parts, including the intake valves, exhaust valves, intake valve underside, intake manifold, and spark plugs.

Each engine is run for 110 hours (equivalent to approximately 4,000 miles) with a straight mineral SAE 10 oil. This oil is an ashless mineral oil so that the combustion chamber deposits that result from the running of the engine are due only to the composition of the gasoline and not to metals in the oil. The additive of Example 1 is added to the base gasoline in amounts sufficient to produce a gasoline containing 10 ptb of additive.

The base gasoline contains 0.2 TP phosphorus and 2.8 ml/gal. TEL and with and without the additive of the present invention has the following inspections:

TABLE II

| Base Gasoline Inspection | Without Additive | With Additive |
|---|---|---|
| ASTM Distillation, Method D-86 | | |
| Initial boiling point, °F. | 85 | 92 |
| 50° overhead, °F. | 201 | 204 |
| Final boiling point, °F. | 362 | 384 |
| ASTM gum | | |
| mg/100 ml washed | 3.2 | 3.6 |
| mg/100 ml unwashed | 6.6 | 7.6 |
| FIA analysis (Fluorescent Indicator Analysis) | | |
| Vol. percent saturates | 73.9 | 73.4 |
| Vol. percent aromatics | 20.1 | 20.8 |
| Vol. percent olefins | 6.0 | 5.8 |
| RVP (Reid Vapor Pressure) | | |
| P.S.I.G. | 9.7 | 8.50 |
| Phosphorus | | |
| mg/100 ml | 0.88 | 0.82 |
| Na | | |
| ppm | 0.5 | 1.0 |

The test results for each gasoline is as follows:

TABLE III

| | Base Gasoline Without Additive | Base Gasoline With Additive |
|---|---|---|
| Intake Valves | Shows torching throughout and some burning | Very good |
| Combustion Chamber Deposits | Light | Light, softer than deposits obtained with base gasoline without additive |
| Intake Manifold | Heavier than base gasoline with additive | Light deposit |
| Intake Valve Underside | Two to three valves have rather heavy deposit | Even deposits, no heavy deposits |
| Spark Plugs | Good | Somewhat heavier than base gasoline without additive, but all deposits are soft |
| Exhaust Valves | Some valves contain black deposits underneath indicating torching throughout | Very good |

Table III shows that the gasoline containing the sodium additive in accordance with the present invention shows the best combustion chamber clean-up.

The engines are reconditioned and the tests are rerun, but this time the engine that was initially run with the base gasoline without additive is now run with the base gasoline with additive. Similarly, the engine that was initially run with the base gasoline containing an additive is now run with the base gasoline without additive. In this rerun, the additive is incorporated into the base gasoline in an amount of 20 ptb. Each engine is run for another 110 hours and then examined. The results of this rerun confirm that the best combustion chamber clean-up is obtained with the gasoline containing the sodium additive of the present invention. The engine run with the additive containing gasoline shows reduced combustion chamber deposits, reduced intake port deposits, and reduced piston short varnish, as compared to the engine run with the base gasoline without additive.

EXAMPLE 4

Two Wisconsin gasoline engines are run with identical stock S.E. oils and premium base stock gasolines containing 2.8 ml/gal. TEL, except that one gasoline has added to it 5 ptb of the additive of Example 1. The Wisconsin engine is a single-cylinder L-head engine in which the fuel is mixed with air in a carburetor. The engine is equipped with a removable intake manifold. During the test, the temperature of the air/fuel mixture in the manifold and the temperature of the intake air are controlled at 115°F. and 125°F., respectively, to simulate typical intake conditions. The engines are run for 8 hours. The engine operated with the gasoline with additive shows a slightly greater deposit than the engine operated with the gasoline containing no sodium additive. The engines are now run for an additional 36 hours. After this run, the deposits on each engine look the same.

The engines are now run for an additional 36 hours, but during this run, each engine is operated with identical gasoline base stocks containing no sodium additive to dirty the engines. After this run, the engines are run for 36 additional hours, but during this run, each engine is operated with identical gasoline base stocks, each containing 10 ptb of sodium additive. After the run is completed, both engines show a clean-up in their combustion chambers as compared to the previous 36-hour run with gasolines having no sodium addition. The engines have very low deposit levels in their combustion chambers and have clean valves.

Additional Wisconsin engine tests are run on two new engines. One of the engines is operated with Amoco premium no lead gasoline, while the other is run with the same Amoco premium no lead gasoline containing 15 ptb of the sodium additive of Example 1. After about 36 hours, each engine shows little deposits, however, the deposits on the cylinder head of the engine run with the sodium additive containing gasoline, are softer and more powdery.

The present invention in its broader aspects is not limited to the specific details shown and described above, but departures may be made from such details without departing from the principles of the invention and without sacrificing its chief advantages.

What is claimed is:

1. A lead-free gasoline composition comprising a major proportion of gasoline having a total metal content of less than about 2 parts per million of lead and about 1.7 to 13.6 parts per million of sodium; said sodium being present in the form of a sodium additive effective in inhibiting valve seat recession and in an amount equivalent to about 0.5 to about 4 pounds of sodium per thousand barrels of gasoline; said sodium additive being a colloidal dispersion of sodium carbonate formed by adding carbon dioxide and an aqueous solution of sodium hydroxide to an oil solution of: a $P_2S_5$ treated polyisobutylene having a molecular weight in the range of about 700–100,000 as a surfactant, and an alkyl phenol having a molecular weight in the range of about 200 to 700 as a promoter; and heating to dehydrate the resulting mixture and to form said sodium additive.

* * * * *